United States Patent [19]

Popovich

[11] 4,165,075

[45] Aug. 21, 1979

[54] FISHING GAME DEVICE

[75] Inventor: Mark Popovich, Ruskin, Fla.

[73] Assignee: Fair Equipment Company, Inc., Arlington, Va.

[21] Appl. No.: 811,683

[22] Filed: Jun. 30, 1977

[51] Int. Cl.[2] ..... A63H 23/10

[52] U.S. Cl. ..... 273/140

[58] Field of Search ..... 273/140, 1 M, 126 A, 273/135 AD, 1 R; 272/1 B, 71, 26; 46/236, 239, 45, 91; 40/27.5; 35/7 A; 194/4 F, 4 R, 4 B, 4 C, 4 D, 4 E, 4 G; 104/73

[56] References Cited

U.S. PATENT DOCUMENTS

| | | | |
|---|---|---|---|
| 184,289 | 11/1876 | Lingg | 40/27.5 |
| 800,217 | 9/1905 | Keplinger | 40/27.5 |
| 930,613 | 8/1909 | Pressey | 273/140 |
| 934,179 | 9/1909 | Jackson | 273/140 |
| 1,331,270 | 2/1920 | Lippincott | 272/26 X |
| 1,389,611 | 9/1921 | Wood et al. | 273/140 UX |
| 2,408,141 | 9/1946 | Heil | 273/140 X |
| 2,509,785 | 5/1950 | Rubin | 273/140 X |
| 3,403,907 | 10/1968 | Keller | 273/106 B X |
| 3,982,343 | 9/1976 | Klingler | 40/27.5 |

FOREIGN PATENT DOCUMENTS

| | | | |
|---|---|---|---|
| 399442 | 10/1933 | United Kingdom | 273/140 |

*Primary Examiner*—Richard C. Pinkham
*Assistant Examiner*—Arnold W. Kramer
*Attorney, Agent, or Firm*—Shlesinger, Arkwright, Garvey and Dinsmore

[57] ABSTRACT

A fishing game device is disclosed in which discs of various sizes and colors each containing a ferromagnetic material float on the surface of water which is circulated in a continuous channel and fishing poles having magnets attached to the ends of their lines are used to retrieve the discs. Each disc is formed from two spaced plates having a resilient gasket with a central opening positioned between the plates. The central opening contains the piece of ferromagnetic material. The discs are so arranged and constructed that the chance of retrieving discs of different sizes and colors varies.

19 Claims, 10 Drawing Figures

FISHING GAME DEVICE

BACKGROUND AND OBJECTS OF THE INVENTION

The invention relates generally to amusement devices such as those used as carnivals, state fairs, etc.

The closest prior art of which Applicant is aware are U.S. Pat. Nos. 2,557,789 to Lamka, 465,391 to Samuels, 930,613 to Pressey, 2,747,872 to Harvey, and 3,627,316 to Machinski which generally disclose fishing game devices in which fishing poles having magnets or hooks on the ends of their lines are used to retrieve fish-shaped objects which have ferromagnetic members or hook engaging members.

None of the devices disclosed in these patents show any features which render one fish-shaped object more or less easily retrievable than another within the same device. Nor do they show the use of a flat disc as a target object with a construction permitting the varying of the chance of retrieving the target.

A feature of the fishing game device of this invention is the capacity to vary the chance of retrieving different targets by varying the arrangement and construction of the targets.

A feature of the device of this invention is the capacity to vary the chance of retrieving different targets by varying the size, shape and location of the ferromagnetic material within each target, by varying the sizes of different targets, by varying the ratio of the surface area of the ferromagnetic material to the surface area of the target for different targets, or by varying the magnetic attractability of different targets.

Another feature of the device of this invention is the use of targets having a variety of colors and sizes which vary with respect to the chance a player has to retrieve them.

Another feature of the invention is the further varying of the chance of retrieving a target of a specific size and/or color by varying the number of targets of that size and/or color in use.

A further feature of the invention is the use of flat discs as targets with a construction permitting the varying of the change of retrievability.

Another feature of the invention is the use of more than one pump unit for circulating water by which the game can be kept in operation in the event one pump fails.

An additional feature of the invention is the presence of mirrors which enable children who are not tall enough to see the water surface directly to see it through the mirrors and thus be able to play.

A further feature of the invention is the provision of a game device which is easy and inexpensive to build and maintain.

SUMMARY OF THE INVENTION

The invention concerns a fishing game device which has a water-containing open-top tank, discs floating on the water surface, each disc having two-spaced plates, a gasket having a central opening positioned between said plates and a piece of ferromagnetic material located in the central opening, and a magnetic retriever which may be in the form of a pole having a line attached thereto with a magnet connected to the other end of the line. The plates may be made from a rigid material and the gasket may be made from a resilient material. Each disc may be provided with spacers in its central opening to hold its piece of ferromagnetic material in a substantially fixed position. The discs are arranged in groups with the discs of each group having a common visible characteristic distinguishing them from other groups. The discs are so arranged and constructed that the chance of retrieving a disc from one group is different from the chance of retrieving a disc from other groups. The tank may be in the form of a continuous channel having a water pump or a plurality of such pumps to circulate the water around the channel. The intakes for these pumps may be located in sumps so as to minimize the tendency of the pumps to draw discs from the water surface. The tank may be provided with mirrors above the water surface which aid users in seeing the water surface and the discs thereon.

DESCRIPTION OF THE PREFERRED EMBODIMENT

Figure 1:
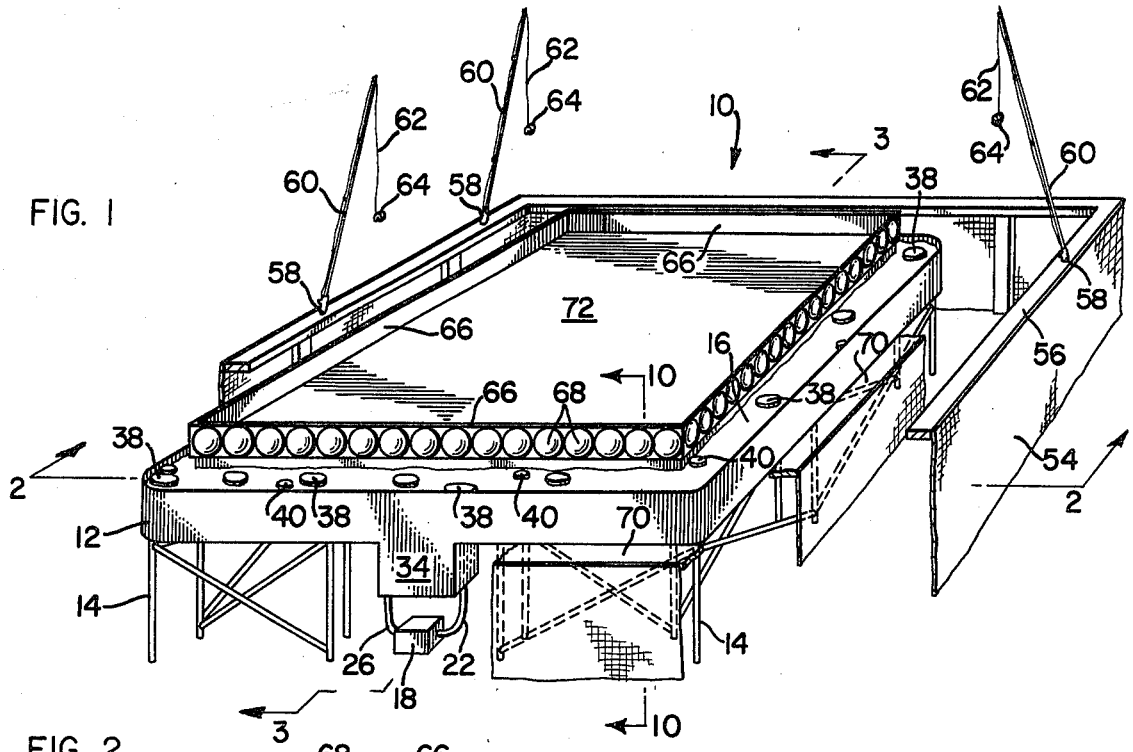
FIG. 1 is a perspective view partially in section of a preferred embodiment of the fishing game device of this invention.
Figure 2:
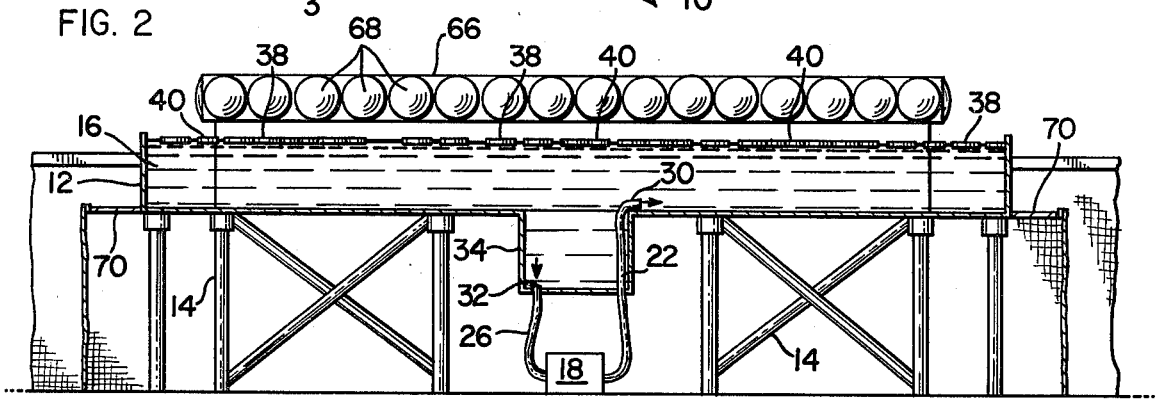
FIG. 2 is a sectional view of the device of FIG. 1 taken on the line 2—2 in FIG. 1 and viewed in the direction of the arrows.
Figure 3:
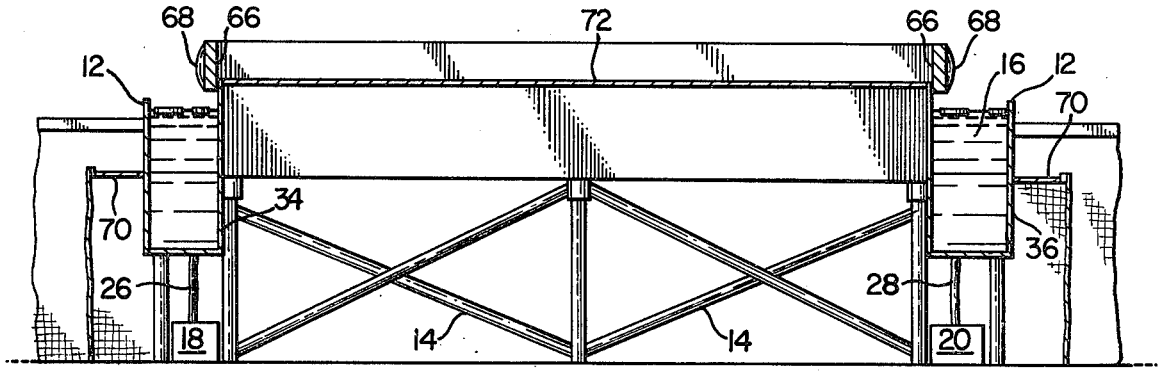
FIG. 3 is a sectional view of the device of FIG. 1 taken on the line 3—3 in FIG. 1 and viewed in the direction of the arrows.
Figure 4:
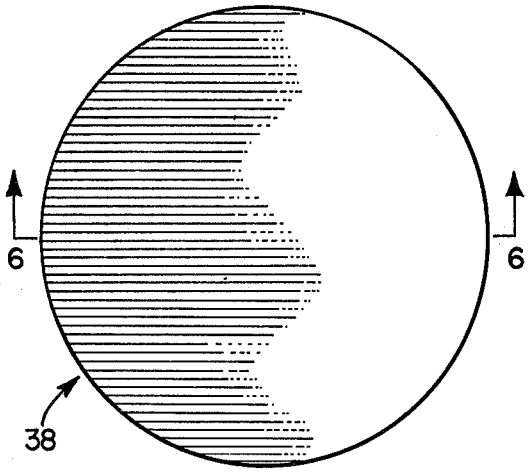
FIGS. 4 and 5 are plan views of the different size discs of the fishing game device.

Referring to the drawings, there is shown a fishing game device 10 according to the invention.

A tank 12 in the form of a continuous channel is mounted upon a support frame 14. The tank 12 is rectangular in cross-section, open at the top and is filled with water 16 to any desired level.

The water 16 in the tank 12 is circulated in continuous flow in one direction by two circulation pumps 18, 20 which are connected by means of output hoses (only the output hose 22 for pump 18 is shown) and intake hoses 26, 28 to the tank 12. The intake hoses 26, 28 serve to draw the water 16 from the tank 12 into the pumps 18, 20 while the output hoses 22 serve to feed the water 16 back into the tank 12. The ends of the output hoses (only the end 30 of output hose 22 is shown) are positioned at the base of the tank 12 or wherever they can most effeciently generate continuous flow. The ends of the intake hoses 26, 28 (only the end 32 of the intake hose 26 is shown) are positioned at or near the bases of sumps 34, 36 because if not positioned well below the water surface the force of their suction could draw the discs 38, 40 from the surface and possibly block their intake openings.

While in this preferred embodiment, the tank 12 has been equipped with two pumps 18, 20 and sumps 34, 36, the device can have any number of pumps and corresponding sumps depending on the rate of water flow desired and the power of each individual pump. While the device can work with only one pump, a plurality of pumps is preferred so that, in the event one pump should fail, the device can be kept running.

Floating on the water surface are generally horizontally disposed round discs 38, 40. The discs 38 are all of the same diameter and color while the discs 40 are all of the same diameter and color but with a smaller diameter than the discs 38 and a different color.

The discs 38, 40 are carried by the force of the water current about the water tank 12.

Figure 5:
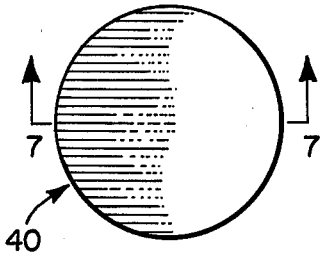
Figure 6:
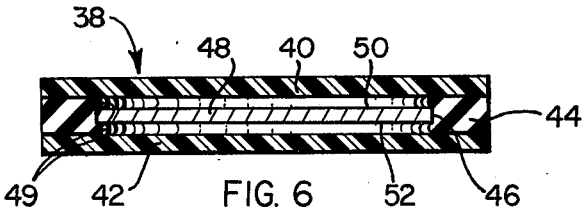
FIGS. 6 and 7 are sectional views of the discs of FIGS. 4 and 5 respectively taken on the lines 6—6 and 7—7 of FIGS. 4 and 5 respectively and viewed in the directions of the arrows.
Figure 7:
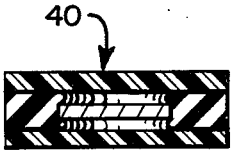

The structure of the individual discs 38 and 40 is shown in FIGS. 4 through 7. While this discussion will deal with the structure of the large discs 38 of FIGS. 4 and 6 it should be kept in mind that the structure of the smaller discs 40 of FIGS. 5 and 7 is exactly the same and, therefore, this discussion applies equally well to it. Each disc 38 is composed of two plates 40 and 42 which may be made from a material which is light enough in weight so that the overall structure will be buoyant. This material must be non-porous throughout or non-porous at the surface so that the disc 38 will not absorb water and sink. The plates 40 and 42 and, consequently, the disc 38 is circular in shape but the discs may be units made in any appropriate shape or variety of shapes. It is also preferable for the plates 40 and 42 to be rigid. These goals are best achieved by using a synthetic resin material to make the plates 40 and 42.

Positioned between the plates 40 and 42 is a gasket 44 having a central opening defined by its interior wall 46. This gasket 44 may be made from a resilient material and must also be non-porous throughout or non-porous at the surface to prevent the absorption of water. The gasket 44 is connected to the plates 40 and 42 by an adhesive or by any suitable connecting means.

Located in the central opening 46 of the gasket 44 is ferromagnetic material 48 which may be of any shape, size or consistency which will fit into the central opening 46. The ferromagnetic material 48 may be left free to move about or, as shown in FIG. 6, may be held in a position substantially fixed in relation to the plates 40 and 42 and gasket 44 which in the structure shown in FIG. 6 is achieved by shaping the ferro-magnetic material 48 to the shape of the central opening 46 and positioning it by embedding it slightly in the resilient material of the gasket 44 so that beads 49 are formed which hold the ferro-magnetic material 48. The ferromagnetic material 48 has horizontal surfaces 50 and 52 which are roughly parallel to the outside surfaces of the plates 40 and 42.

In the event the ferromagnetic piece 48 is of a different shape, any appropriate form of packing or spacing for the material 48 may be used.

The discs may be one piece and blow molded with the ferromagnetic material inside or two pieces and fitted together and sealed with the magnetic material within.

As can be seen in FIGS. 6 and 7, the overall disc structure 38 or 40 may be left with air pockets to add to the disc's buoyancy. The volume of the air pockets and the densities and sizes of the various components of the disc structure are all pertinent factors in regulating the buoyancy of the discs 38 and 40.

Figure 8:
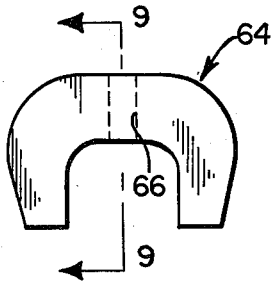
FIG. 8 is an elevational view of a magnet which may be used in the fishing game device.
Figure 9:
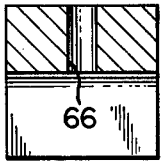
FIG. 9 is a sectional view of the magnet of FIG. 8 taken on line 9—9 of FIG. 8 and viewed in the direction of the arrows.
Figure 10:
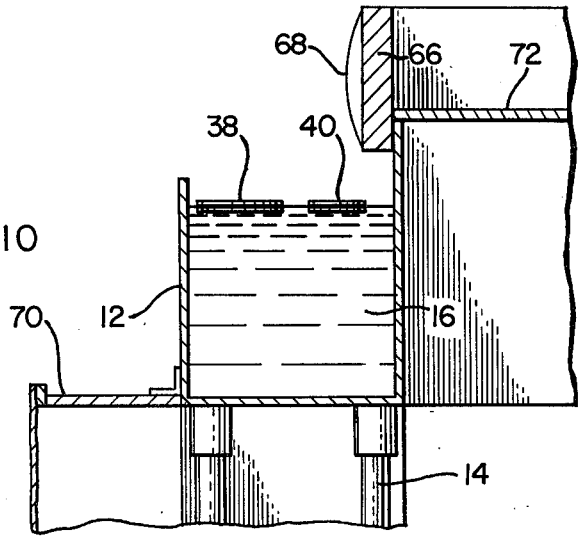
FIG. 10 is an enlarged cross-sectional view of the device of FIG. 1 taken on the line 10—10 of FIG. 1 and viewed in the direction of the arrows.

Surrounding the tank 12 and spaced a suitable distance therefrom is a barrier 54 having a countertop 56 outside of which users of the device stand. Mounted on the countertop 56 are a series of holders 58 only some of which are shown in FIG. 1 for purposes of illustration. In each of these holders 58, a pole 60 is detachably mounted which may be an ordinary fishing pole. To each pole 60, a line 62 is fastened, the free end of which has a magnet 64 attached to it. Such a magnet 64 is shown in FIGS. 8 and 9 which in this case is a simple U-shaped two pole magnet. The magnet 64 has an opening 66 by which the line 62 may be fastened to it. Any appropriately shaped magnet may be used, however.

In use players standing outside the barrier 54 use the poles 60 and lines 62 with magnets 64 attached to fish for and individually retrieve the floating discs 38 and 40 traveling in the tank 12. When the magnet 64 on the end of a line 62 draws near a disc 38 or 40, the disc will become magnetically attached by means of the ferromagnetic material 48 and will be retrieved.

The discs 38 are larger than the discs 40 and contain a piece of ferromagnetic material 48 which is larger in horizontal surface area 50, 52 than the piece of ferromagnetic material in the smaller discs 40. Therefore, there is an increased chance that a magnet 64 will make contact with a disc 38 rather than a disc 40. More or less valuable prizes are then awarded corresponding to the degree of difficulty involved in retrieving a particular disc.

The different sizes of the discs 38, 40 are a visible indication to the player of which discs are more difficult to retrieve. To aid the player in visually distinguishing discs, the smaller discs 40 are colored red while the larger discs 38 are colored yellow.

The discs may be arrayed in a variety of ways in addition to the manner described above. The invention encompasses any organization in which the ferromagnetic material contained in the discs varies in some characteristic among the discs so that the ease of retrievability of the discs varies. The ease with which the discs are retrieved may be varied by varying the amount, size, and/or shape of the ferromagnetic material among the discs. As shown in the illustrated embodiment, increasing the horizontal surface area of the ferromagnetic material will increase the ease with which the disc containing that material may be retrieved. Different surface areas will result in varying degrees of difficulty.

The ease with which discs can be retrieved can also be varied by varying the ratio of the ferromagnetic material's horizontal surface area to the disc's horizontal surface area. If the ferromagnetic material in a disc occupies an area proportionally smaller, then a player aiming a magnet for the disc will not attach the magnet if he misses the ferromagnetic material even if he contacts the disc. On the other hand, if the ferromagnetic material has a large relative surface area, contact with the disc will almost certainly result in its retrieval. The central opening for the ferromagnetic material can be placed off center somewhat to further confuse players.

The ease with which discs are retrieved can also be varied by varying the magnetic attractability of the discs. This can be achieved, for instance, by using different alloys of ferromagnetic material which have different degrees of responsiveness to magnets or by situating the ferromagnetic material between relatively thick plates so that a magnet contacting the discs will be a greater distance from the ferromagnetic material and, consequently, will not hold it as well. A piece of ferromagnetic material close to the surface of a disc will be more strongly held by a magnet.

The discs may be made visibly distinguishable by varying their size alone or their color alone or their size and color may be varied in correlation to one another. Different shapes may also be used. Additionally, the ease of retrievability of the discs may be correlated to their size and/or color. Also, the ease with which a disc of a given size and/or color may be retrieved can be varied by varying the number of discs of that size and/or color present.

If it is desired to prevent the walls of the tank 12 from attracting the magnet 64, the tank 12 can be made from a non-ferromagnetic material.

Mounted above the tank 12 upon support 66 are a plurality of convex mirrors 68 which are positioned so as to enable players to see the water surface by viewing it through the mirrors 68. This feature is of particular help to children who are not tall enough to see the water surface directly. Convex mirrors are not the only form of reflectors which may be used. Any reflective surface which aids the view of the water surface may be used.

The space between the tank 12 and the barrier 54 is used by attendants in operating the device 10.

Immediately in front of the tank 12 and behind the mirror support 66 are shelf 70 and platform 72 which are used to display the prizes awarded to successful players.

Additionally, other fluids besides water may be used with the device.

It will be understood that the invention is capable of further modification. This application, is, therefore, intended to cover any variations, uses, or adaptations of the invention following the general principles thereof and including such departures from the present disclosure as come within known or customary practice in the art to which this invention pertains, and as may be applied to these essential features hereinbefore set forth and fall within the scope of this invention or the limits of the claims.

What is claimed is:

1. A fishing game device, comprising:

an open-top tank having a fluid therein;

a plurality of floating units on said fluid's surface, each of said units having ferromagnetic material contained therein;

means for causing a flow of said fluid in said tank whereby said units travel about said tank;

means for a player positioned at a distance from said tank to retrieve said units individually from said fluid's surface, said retrieving means including a magnet to engage said ferromagnetic material;

said units varying in size; and said ferromagnetic material varying in size among said units whereby the chance of retrieving units of different sizes by a player positioned at a distance from said tank varies among said units.

2. A fishing game device, comprising:

an open-top tank having a fluid therein;

a plurality of floating units on said fluid's surface, each of said units having ferromagnetic material contained therein;

means for causing a flow of said fluid in said tank whereby said units travel about said tank;

means for a player positioned at a distance from said tank to retrieve said units individually from said fluid's surface, said retrieving means including a magnet to engage said ferromagnetic material;

said units varying in shape; and said ferromagnetic material varying in size among said units whereby the chance of retrieving units of different shapes by a player positioned at a distance from said tank varies among said units.

3. A fishing game device, comprising:

an open-top tank having a fluid therein;

a plurality of floating units on said fluid's surface, each of said units having ferromagnetic material contained therein;

means for causing a flow of said fluid in said tank whereby said units travel about said tank;

means for a player positioned at a distance from said tank to retrieve said units individually from said fluid's surface, said retrieving means including a magnet to engage said ferromagnetic material, said units varying in size; and said ferromagnetic material varying in horizontal surface area among said units whereby the chance of retrieving units of different sizes by a player positioned at a distance from said tank varies among said units.

4. A fishing game device, comprising:

an open-top tank having a fluid therein;

a plurality of floating units on said fluid's surface, each of said units being generally horizontally disposed and having ferromagnetic material contained therein;

means for causing a flow of fluid in said tank whereby said units travel about said tank;

means for a player positioned at a distance from said tank to retrieve said units individually from said fluid's surface, said retrieving means including a magnet to engage said ferromagnetic material;

said floating units varying in horizontal surface area; and said ferromagnetic material varying in horizontal surface area among said units whereby the chance of a player positioned at a distance from said tank of retrieving units of different horizontal surface area varies among said units.

5. The fishing game device of claim 4 wherein the ratio of the horizontal surface area of said ferromagnetic material in each of said units to that of the horizontal surface area of that unit varies among said units.

6. The fishing game device of claim 5 wherein said units are discs.

7. The fishing game device of claim 6 wherein each of said discs has two spaced plates and a gasket having a central opening positioned between said plates with said ferromagnetic material located in said central opening.

8. The fishing game device of claim 7 wherein said plates are made from a rigid material and said gasket is made from a resilient material.

9. The fishing game device of claim 7 wherein holding means is contained in said central opening for holding said ferromagnetic material in a substantially fixed position.

10. The fishing game device of claim 7 wherein said tank is in the form of a continuous channel and said fluid flow causing means is at least one fluid circulation pump which causes a flow of fluid around said channel.

11. The fishing game device of claim 7 and including reflective means for aiding the users of said device in seeing the fluid's surface.

12. The fishing game device of claim 7 wherein said retrieving means also includes a line to one end of which said magnet is attached and a pole to which the other end of said line is attached.

13. The fishing game device of claim 7 and including a plurality of convex mirrors positioned so as to enable players to see the fluid's surface by viewing it through said plurality of mirrors.

14. The fishing game device of claim 7 wherein said discs are of different colors and the horizontal surface areas of said discs are correlated to the colors of said discs.

15. The fishing game device of claim 4 wherein said tank is in the form of a continuous channel and said fluid flow causing means is at least one fluid circulation pump which causes a flow of fluid around said channel.

16. The fishing game device of claim 4 and including reflective means for aiding the users of said device in seeing the fluid's surface.

17. The fishing game device of claim 4 and including a plurality of convex mirrors positioned so as to enable players to see the fluid's surface by viewing it through said plurality of mirrors.

18. The fishing game device of claim 4 wherein said retrieving means also includes a line to one end of which said magnet is attached and a pole to which the other end of said line is attached.

19. A fishing game device, comprising:

an open-top tank in the form of a continuous channel having a fluid therein;

a plurality of floating discs on said fluid's surface, each of said discs being generally horizontally disposed and having two spaced plates, a gasket having a central opening positioned between said plates, and ferromagnetic material contained therein;

means for causing a flow of fluid in said tank whereby said discs travel about said tank;

a line having a magnet attached at one end to engage said ferromagnetic material and a pole at the other end by which a player positioned at a distance from said tank can retrieve said discs individually from said fluid's surface;

said discs varying in horizontal surface area;

said ferromagnetic material varying in horizontal surface area among said discs whereby the chance of a player positioned at a distance from said tank of retrieving discs of different horizontal surface area varies among said discs; and a plurality of convex mirrors positioned so as to enable players to see the fluid's surface by viewing it through said plurality of mirrors.

* * * * *

REEXAMINATION CERTIFICATE (1222nd)

United States Patent [19]

Popovich

[11] B1 4,165,075

[45] Certificate Issued Mar. 20, 1990

[54] FISHING GAME DEVICE

[75] Inventor: Mark Popovich, Ruskin, Fla.

[73] Assignee: Fair Equipment Company, Inc., Arlington, Va.

Reexamination Request:
No. 90/001,092, Sep. 16, 1986

Reexamination Certificate for:

| | |
|---|---|
| Patent No.: | **4,165,075** |
| Issued: | **Aug. 21, 1979** |
| Appl. No.: | **811,683** |
| Filed: | **Jun. 30, 1977** |

[51] Int. Cl.[4] ..... A63H 23/10
[52] U.S. Cl. ..... 273/140
[58] Field of Search ..... 273/140, 1 GD, 1 GG

[56] References Cited

U.S. PATENT DOCUMENTS

| | | | |
|---|---|---|---|
| 450,395 | 4/1891 | Boynton . | |
| 484,950 | 10/1892 | Dungey . | |
| 550,476 | 11/1895 | Braaf | 273/140 |
| 626,995 | 6/1899 | Haigh . | |
| 1,640,259 | 8/1927 | Vallat | 273/140 |
| 2,146,194 | 2/1939 | Rubens et al. | 273/140 |
| 2,557,789 | 6/1951 | Lamka | 273/140 |
| 3,106,394 | 10/1963 | Gelbart | 272/8 |
| 3,214,863 | 11/1965 | Bernstein et al. | 46/242 |
| 3,249,357 | 5/1966 | Luchsinger | 273/1 |
| 3,596,750 | 8/1971 | Nathan | 206/62 |
| 3,627,316 | 12/1971 | Machinski | 273/1 |
| 3,712,616 | 1/1973 | Goldfarb | 273/1 GG |
| 3,788,641 | 1/1974 | Lemelson | 273/1 |
| 3,853,321 | 12/1974 | Claffie | 273/1 GD X |

FOREIGN PATENT DOCUMENTS

| | | | |
|---|---|---|---|
| 784867 | 5/1935 | France | 273/140 |

*Primary Examiner*—Paul E. Shapiro

[57] ABSTRACT

A fishing game device is disclosed in which discs of various sizes and colors each containing a ferromagnetic material float on the surface of water which is circulated in a continuous channel and fishing poles having magnets attached to the ends of their lines are used to retrieve the discs. Each disc is formed from two spaced plates having a resilient gasket with a central opening positioned between the plates. The central opening contains the piece of ferromagnetic material. The discs are so arranged and constructed that the chance of retrieving discs of different sizes and colors varies.

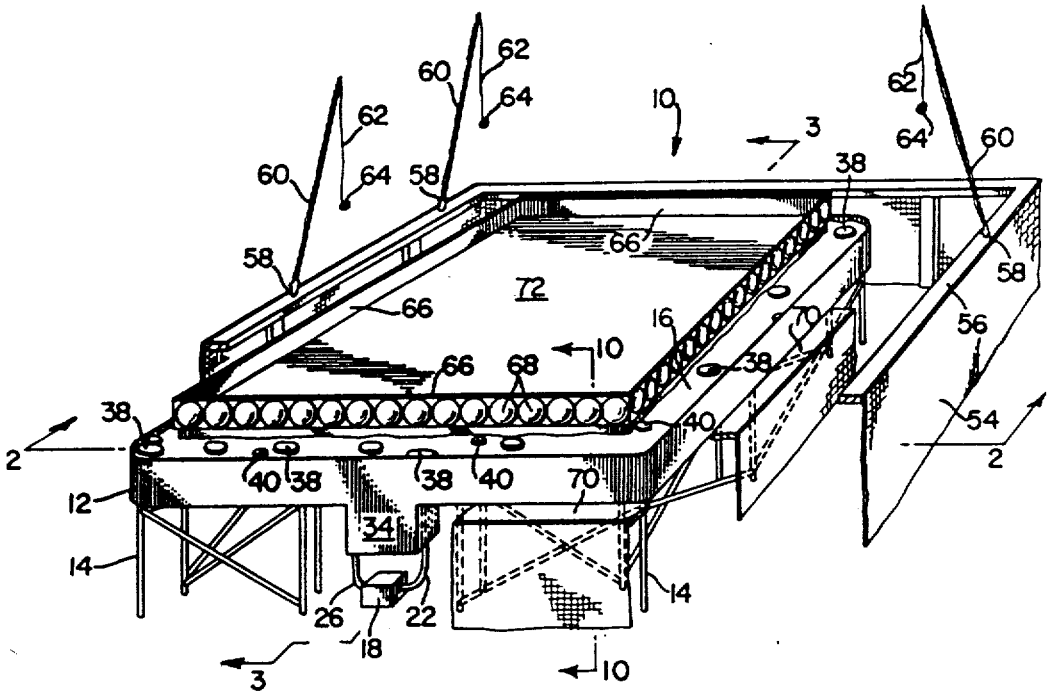

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3–6 and 15–19 is confirmed.

Claims 1 and 2 are cancelled.

Claim 7 is determined to be patentable as amended.

Claims 8–14, dependent on an amended claim, are determined to be patentable.

New claims 20–37 are added and determined to be patentable.

7. The fishing game device of claim 6 wherein [each] *at least one* of said discs has two spaced plates and a gasket having a central opening positioned between said plates with said ferromagnetic material located in said central opening.

*20. The fishing game device of claim 2, wherein at least one of said units includes a disc, said disc includes two spaced plates and a gasket having a central opening positioned between said plates with said ferromagnetic material located in said central opening.*

*21. The fishing game device of claim 2 wherein:*

*means are operably associated with said units for indicating the value thereof;*

*at least one of said units having a value differing from at least one other of said units;*

*said ferromagnetic material varies in size among said units inversely proportional to the value of the unit.*

*22. The fishing game device of claim 3 wherein at least one of said units includes a disc, said disc includes two spaced plates and a gasket having a central opening positioned between said plates with said ferromagnetic material located in said central opening.*

*23. The fishing game device of claim 3 wherein said ferromagnetic material is wholly contained within said units.*

*24. The fishing game device of claim 3 wherein:*

*means are operably associated with said units for indicating the value thereof;*

*at least one of said units having a value differing from at least one other of said units;*

*said ferromagnetic material varies in horizontal surface area among said units inversely proportional to the value of the unit.*

*25. The fishing game device of claim 7 wherein each of said of said discs has two spaced plates and a gasket having a central opening positioned between said plates with said ferromagnetic material is located in said central opening.*

*26. The fishing game device of claim 25 wherein said plates are made from a rigid material and said gasket is made from a resilient material.*

*27. The fishing game device of claim 25 wherein holding means are contained in said central opening for holding said ferromagnetic material in a substantially fixed position.*

*28. The fishing game device of claim 25 wherein said tank is in the form of a continuous channel and said fluid flow causing means is at least one fluid circulation pump which causes a flow of fluid around said channel.*

*29. The fishing game device of claim 25 and including reflective means for aiding the users of said device in seeing the fluid's surface.*

*30. The fishing game device of claim 25 wherein said retrieving means also includes a line to one end of which said magnet is attached and a pole to which the other end of said line is attached.*

*31. The fishing game device of claim 25 and including a plurality of convex mirrors positioned so as to enable players to see the fluid's surface by viewing it through said plurality of mirrors.*

*32. The fishing game device of claim 25 wherein said discs are of different colors and the horizontal surface area of said discs are correlated to the colors of said discs.*

*33. The fishing game device of claim 4 wherein at least one of said units includes a disc, said disc includes two spaced plates and a gasket having a central opening positioned between said plates with said ferromagnetic material located in said central opening.*

*34. The fishing game device of claim 4 wherein said ferromagnetic material is wholly contained within said units.*

*35. The fishing device of claim 4 wherein:*

*means are operably associated with said units for indicating the value thereof;*

*at least one of said units having a value differing from at least one other of said units;*

*said ferromagnetic material varies in horizontal surface area among said units inversely proportional to the value of the unit.*

*36. A fishing game device, comprising:*

*an open-top tank having a fluid therein;*

*a plurality of floating units on said fluid's surface, each of said units having ferromagnetic material contained therein;*

*means for causing a flow of said fluid in said tank whereby said units travel about said tank;*

*means for a player positioned at a distance from said tank to retrieve said units individually from said fluid's surface, said retrieving means including a magnet to engage said ferromagnetic material;*

*said units varying in size;*

*said ferromagnetic material varying in size among said units whereby the chance of retrieving units of different sizes by a player positioned at a distance from said tank varies among said units;*

*at least one of said units including a disc; and*

*said disc including two spaced plates and a gasket having a central opening positioned between said plates with said ferromagnetic material located in said central opening.*

*37. A fishing game device, comprising:*

*an open-top tank having a fluid therein;*

*a plurality of floating units on said fluid's surface, each of said units having ferromagnetic material contained therein;*

*means for causing a flow of said fluid in said tank whereby said units travel about said tank;*

*means for a player positioned at a distance from said tank to retireve said units individually from said fluid's surface, said retrieving means including a magnet to engage said ferromagnetic material;*

*said units varying in size;*

*means operably associated with said units for indicating the value thereof;*

*at least one of said units having a value differing from at least one other of said units;*

*said ferromagnetic material varying in size among said units inversely proportional to the value of the units whereby the chance of retrieving units of different sizes by a player positioned at a distance from said tank varies among said units.*

* * * * *